United States Patent [19]

Ito

[11] Patent Number: 4,922,773

[45] Date of Patent: May 8, 1990

[54] THREE-SIDE CUTTING APPARATUS

[75] Inventor: Shoji Ito, Nagoya, Japan

[73] Assignee: Itoh Iron Works Co., Ltd., Inuyama, Japan

[21] Appl. No.: 363,797

[22] Filed: Jun. 9, 1989

Related U.S. Application Data

[63] Continuation of Ser. No. 141,028, Jan. 5, 1988, abandoned.

[51] Int. Cl.[5] ..... B26D 1/09; B26D 5/06

[52] U.S. Cl. ..... 83/76.6; 83/207; 83/421; 83/731; 83/934; 198/345; 271/236; 271/254

[58] Field of Search ..... 83/925 A, 71, 731, 368, 83/421, 207, 934, 76.6; 198/345; 271/236, 253, 254

[56] References Cited

U.S. PATENT DOCUMENTS

| | | | |
|---|---|---|---|
| 2,520,837 | 8/1950 | Hammond | 83/421 |
| 3,146,650 | 9/1964 | Sarring et al. | 83/925 A |
| 3,176,556 | 4/1965 | Roberts et al. | 83/71 |
| 3,627,301 | 12/1971 | Benson | 270/31 |
| 3,722,336 | 3/1973 | Sarring | 83/421 |
| 3,884,102 | 5/1975 | Faltin | 83/925 A |
| 3,906,829 | 9/1975 | Westfall | 83/713 |
| 3,965,781 | 6/1976 | Stroud | 83/925 A |
| 4,047,457 | 9/1977 | Stubbings | 83/71 |
| 4,202,232 | 5/1980 | Müller | 83/925 A |
| 4,700,758 | 10/1987 | Bernath | 83/368 |

FOREIGN PATENT DOCUMENTS 58-26799 4/1986 Japan .

*Primary Examiner*—Frank T. Yost
*Assistant Examiner*—Rinaldi Rada
*Attorney, Agent, or Firm*—Armstrong, Nikaido, Marmelstein, Kubovcik & Murray

[57] ABSTRACT

A three-side cutting apparatus which cuts a carried-in book at its top, bottom and side. The apparatus comprises top and bottom size setters; transverse size setter; transfer quantity calculating member for calculating a quantity of transfer of the book to the cutting position on the basis of the signal indicative of the transverse size from the transfer size setter and outputting a signal indicative of the transfer quantity; top and bottom cutters for moving a pair of opposing cutters toward and away from each other under control of the signal indicative of the top and bottom sizes; position adjuster controlled in accordance with the signal indicative of the top and bottom sizes for adjusting the position where the book is fed in; aligner controlled by the signal indicative of the transverse size for moving the aligning position and the position of the back of the book; and feed-in member for setting a movement distance based on the signal indicative of the movement quantity and moving the book to the cutting position.

4 Claims, 7 Drawing Sheets

THREE-SIDE CUTTING APPARATUS

This application is a continuation of application Ser. No. 141,028 filed Jan. 5, 1988, now abandoned.

BACKGROUND OF THE INVENTION

1. Field of the Invention

This invention relates to a three-side cutting apparatus which cuts a book or the like on its top, bottom and side at the same time for finishing purposes.

2. Description of the Prior Art

Generally, a three-side cutting apparatus has three cutter edges disposed in the form of a U in a conveyor line in the book binding process. The cutter edges receive a book, to be cut, automatically by means of the conveyor line and cut the book last at predetermined top, bottom and side sizes and feed it out.

Conventionally, in a top and bottom cutting device, the top and bottom and transverse sizes of a book are set by turning a buckle screw threadedly coupling a pair of cutter edges to adjust the distance between the pair of cutter edges while the distance is being measured using a scale.

In the position adjusting unit and aligning unit, knobs are turned so as to set the positions of the respective adjusting members by measuring the positions using a scale.

In the feed-in unit, the angle of a lever moved in conjunction with a pushing member for a book to be cut is adjusted to set the feed distance.

The feed distance determines the relative position of a book to be cut and the side cutter edge to thereby determine the transverse size of the book (an example of such three-side cutting apparatus is disclosed in a Japanese Utility Model Publication Sho 58-26799 (26799/1983).

However, such conventional three-side cutting apparatus has the problem that it takes much time for setting the position of the top and bottom cutter edges, and the sizes by the position adjusting unit and aligning unit.

In the feed-in unit, it is difficult to accurately recognize the relationship between the angle of the lever moved and the feed distance, so that setting of the angle of the lever moved and the recognition of the feed distance are repeated several times to obtain an accurate quantity of feed. Thus the operation is troublesome and time-consuming.

SUMMARY OF THE INVENTION

It is an object of this invention to provide a three-side cutting apparatus which is capable of easily setting the sizes of the top and bottom cutter unit, a position adjusting unit, and an aligning unit and a feed distance by a feed-in unit by keying in data on the top, bottom and transverse sizes at which a book is cut, requires no repetition of feed distance setting by the feed-in unit and performs rapid accurate operation.

It is another object of this invention to provide a three-side cutting apparatus which is capable of performing a cutting operation in a simple manner without requiring any skill, rapidly adjusting to switching one cutting size to another to thereby operate efficiently a conveyor line in a book binding process.

In order to achieve these objects, this invention provides a three-side cutting apparatus which aligns a carried-in book to be cut and transfers it to a cutting position to cut the book at its top and bottom and side, comprising top and bottom size setting means for receiving data on the top and bottom sizes of the book and outputting a signal indicative of the sizes; transverse size setting means for receiving data on the transverse size of the book and outputting a signal indicative of the transverse size; transfer quantity calculating means for calculating a quantity of transfer of the book to the cutting position on the basis of the signal indicative of the transverse size and outputting a signal indicative of the transfer quantity; top and bottom cutter means moving a pair of opposing cutters toward and away from each other under control of the signal indicative of the top and bottom sizes; position adjusting means controlled in accordance with a signal indicative of the top and bottom sizes for adjusting the position where the book is fed in; aligning means controlled by the signal indicative of the transverse size for moving the aligning position and the position of the back of the book; and feed-in means for setting a movement distance based on the signal indicative of the movement quantity and moving the book to the cutting position.

This invention is constructed as just described above. The top and bottom size setting means inputs data on top and bottom sizes at which a book is cut and outputs a signal indicative of the top and bottom sizes.

The top and bottom cutter means is controlled by the signal indicative of the top and bottom size to move a pair of cutter edges relative to each other to desired positions where the cutter edges are fixed.

The position adjusting means is controlled by the top and bottom size signal to move the position where a book to be cut is fed in.

The transverse size setting means receives data on transverse size at which the book is cut and outputs a signal indicative of the transverse size.

The aligning means is controlled by the signal indicative of the transverse size to move to an aligning position.

The feed-in quantity calculating means calculates a quantity of feed of the book in accordance with the signal indicative of the transverse size and outputs a signal indicative of the quantity of feed.

The feed-in means sets a distance of feed in accordance with the signal indicative of the quantity of feed to feed in the book to a position where book is cut.

DESCRIPTION OF THE PREFERRED EMBODIMENTS

Figure 1:
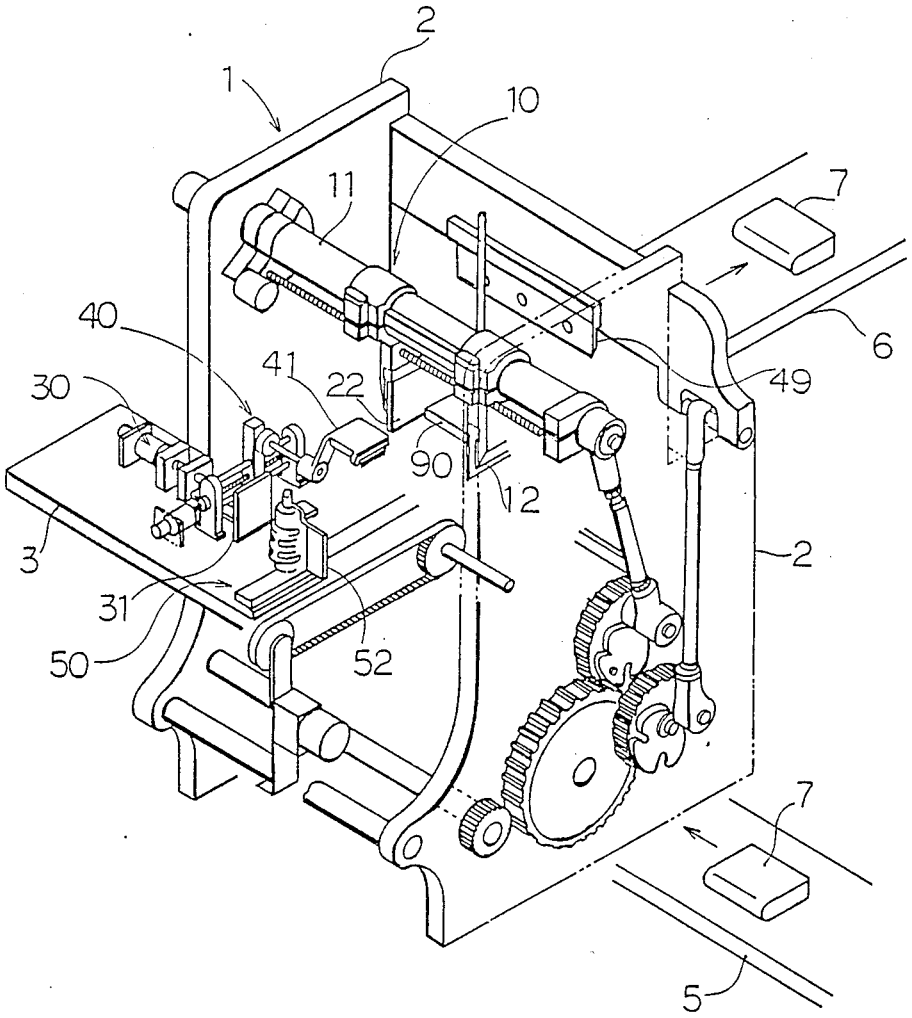
FIG. 1 is a rough schematic of a three-side cutting apparatus of an embodiment of this invention.
Figure 2:
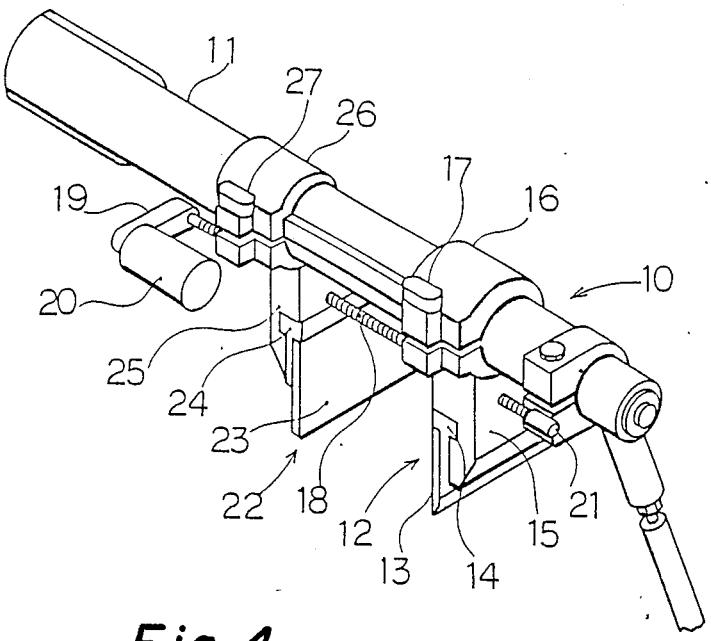
FIG. 2 is a perspective view of a top and bottom cutting unit of the embodiment.
Figure 4:
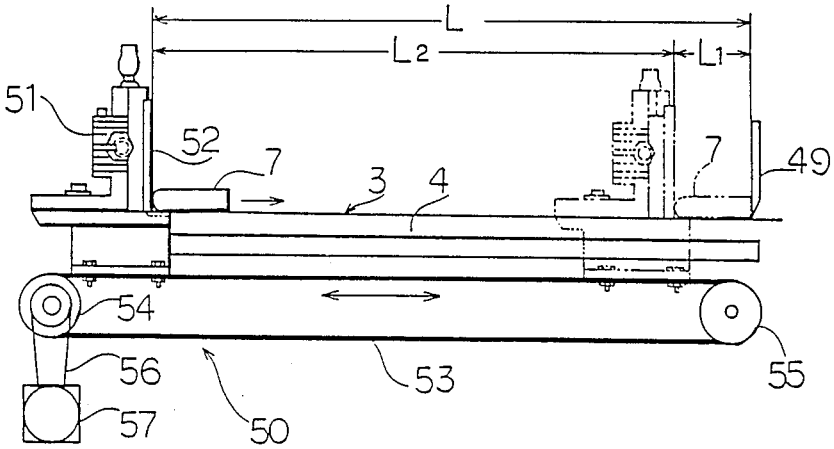
FIG. 4 is a side view of a feed-in unit of the embodiment.

In FIG. 1, the three-side cutting apparatus 1 includes main machine frames 2 and a sequencing drive mechanism and a drive source (none of which is shown). Provided over a base plate 3 is an endless conveyor 5 which carries in a book to be cut 7. Provided after the cutting apparatus 1 is an endless conveyor 6 for carrying purposes.

A top and bottom cutting unit 10 and a side cutter 49 and a hold member 90 which holds the book 7 when cut are provided between the upper portions of the frames 2. A position adjusting unit 30, an aligning unit 40 and a feed-in unit 50 are disposed at predetermined positions on the base plate 3.

A size setting control unit 70 which includes top and bottom size setting means 61, transverse size setting means 62 and feed-in quantity calculating means 63 is disposed on a control panel (not shown). The transverse size setting means 62 and feed-in quantity calculating means 63 comprise a micro-computer having a CPU 74, a ROM 75 and a RAM 76 (see, FIG. 6).

The top and bottom cutting unit 10 includes a cutter guide 11 extending across the frames 2, and opposing cutters 12 and 22 slidable axially on the guide.

The cutters 12 and 22 have cutting blades 13 and 23 which are fixed to frames 15 and 25 by means of holders 14, 24, respectively. The frames 15 and 25 are supported to cutter guides 11 by means of caps 16, 26, respectively. The caps 16 and 26 have clamps 17 and 27 which grip the cutter guide 11 and stop the movement of cutters 12 and 22, respectively. When the top and bottom sizes of cutters 12 and 22 are set, the clamps 17 and 27 are operated by pressurized-air source so as to maintain the set positions of the top and bottom sizes of the cutters 12, 22.

The cutters 12 and 22 are coupled by a turn buckle screw 18 such that they are moved toward and away out of each other by rotating the screw 18. The screw 18 is coupled at one end to a motor 20 via a transmission mechanism 19 and has at the other end an encoder 21 which encodes and outputs as an electric signal a quantity of movement from a reference point. The motor 20 is controlled by a size setting control unit 70 to move the cutters 12 and 22 to desired top and bottom size positions. The cutters 12 and 22 are further driven by a drive mechanism such that they move between a bottom position where the book 7 is last cut at its bottom and a top position spaced from the book 7.

The position adjusting unit 30 has a top and bottom adjusting member 31 orthogonal to the direction in which the book 7 is carried in and upstanding on the base plate 3. The adjusting member 31 has an arm 32 extending parallel to the direction in which the book is carried in.

The arm 32 has a base portion 32*a* through which a feed screw 33 is threadedly engaged. The feed screw 33 is supported rotatable at either end by supports 34 and 35. The screw 33 is also provided at one end with a motor 36 which moves the top and bottom adjusting member 31, and an encoder 37 which outputs a signal indicative of the position of the adjusting member 31.

The motor 36 is controlled by a size setting control unit 70 to rotate the feed screw to move the top and bottom adjusting member 31 in the direction in which the book is carried in such that the top-bottom crossing centerline of the carried-in book 7 aligns with the centerline of the cutters 12 and 22 to abut on the top position or bottom position of the book to adjust the book feed-in position.

Figure 3:
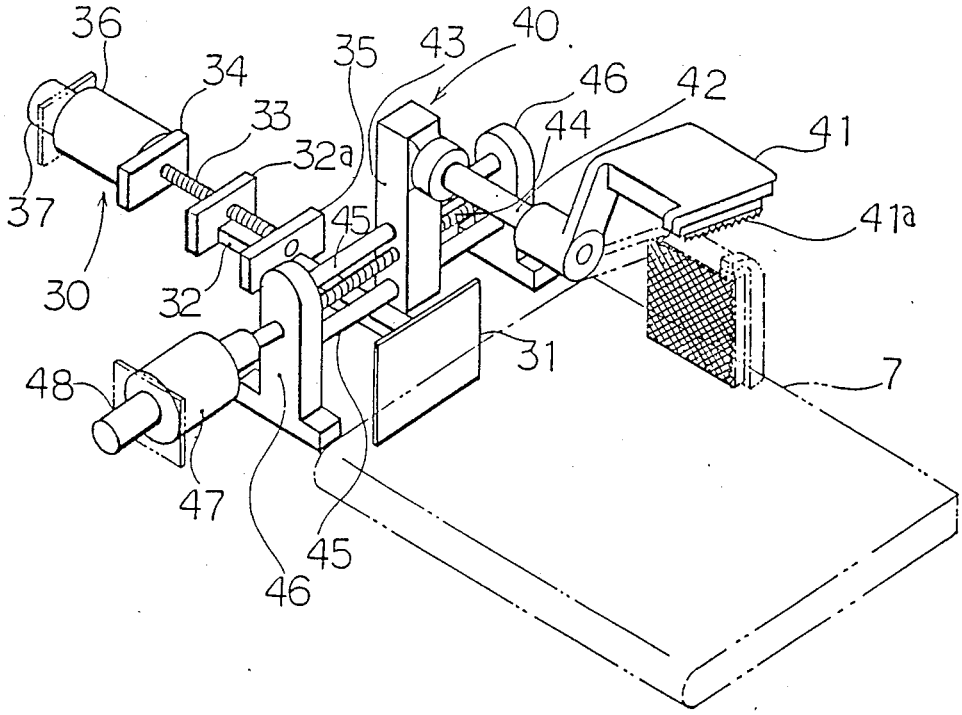
FIG. 3 is a perspective view of a position adjusting unit and aligning unit of the embodiment.

The aligning unit 40 includes a rotatable shaft 42 extending in the direction in which the book 7 is carried in. A substantially L-like aligning member 41 is provided at an end of the shaft 42 while the other end of the shaft 42 is supported rotatable by a moving member 43 and coupled to a drive mechanism (not shown). By the operation of the drive mechanism, the shaft 42 is rotated to thereby move the aligning member 41 between the upper inoperative position and the lower operative position (shown by the dot-dot-dashed line in FIG. 3).

The moving member 43 threadably receives a feed screw 44 and guided by guides 45 so as to move in a direction orthogonal to the direction in which the book is carried in. The feed screw 44 is supported rotatable at either end by supports 46 and has at one end a motor 47 which moves the moving member 43 and an encoder 48 which outputs a signal indicative of the position of the moving member. The guides 45 are fixed at either end to the supports 46.

The motor 47 is controlled by size setting control unit 70 to rotate the screw 44 to adjust the operating or aligning position of the aligning member 41. At this aligning position, the pushing member 41*a* pushes the book 7 at its side such that the book back abuts on a back abutting member 52 to be described later in more detail for aligning purposes.

The feed-in unit 50 includes a drive belt 53 extending in the direction orthogonal to the direction in which the book is carried in and reciprocating between the aligned position of the book 7 and the cutting position below the top and bottom cutter unit 10 and side cutter 49. In the particular embodiment, the drive belt 53 includes a toothed belt and suspended around toothed pulleys 54 and 55. An encoder 58 which outputs a position signal is connected to the pulley 54 to which a motor 57 is coupled via a transmission mechanism 56.

Disposed above the drive belt 53 is a push member 51 protruding upwardly through a groove 4 in the base plate 3. A back abutting member 52 is fixed to the front of the pushing member 51 so as to parallel to the direction in which the book 7 is carried in.

The motor 57 is controlled by size setting control unit 70 to move the back abutting member 52 by a predetermined distance to thereby move the book 7 to a predetermined cutting position and immediately thereafter retracts to return the back abutting member 52 to its original position.

A hold member 90 is provided suspended from a shaft movable vertically between the cutters 12 and 22 and between the upper portions of the frames 2. The hold member 90 includes two vertically separable members. One or upper member 91 has a dovetail groove 92 on its lower surface and extending in a predetermined direction. The member 91 has an air cylinder 93 disposed thereon which has a protrusion 93*a* which can protrude into and retract out of the central dovetail groove 92 under control of an air source.

The other or lower member includes a base plate 94 and a hold plate 97 fixed by a bolt to the plate 94. The base plate 94 has on its upper surface a raised portion 95 fittable into the dovetail 92. A hole 96 is provided at predetermined position in the raised portion 95 and can receive the protrusion 93*a* snugly. A hold plate 97, slightly larger than the base plate 94, is fixed to the lower surface of the base plate 94.

The base plate 94 and hold plate 97 are fitted into dovetail 92 and the protrusion 93*a* into hole 96 for fixing the upper and lower members to each other. The hold member 90 is arranged to move between a lower position where it presses the book 7 placed at the cutting position by the actuation of the drive mechanism and an upper position spaced from the book 7.

Figure 11:
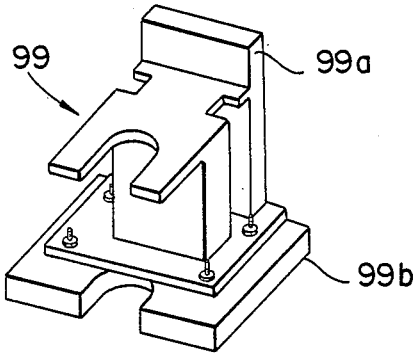
Fig. 11 PRIOR ART
FIG. 11 is a perspective view of a conventional pushing member.

The user is protected from contacting the top and bottom cutters in the vicinity of the hold member 99 when a hold plate 99*b* is replaced for service; thereby, replacing the hold plate 99*b* efficiently as compared to a conventional hold member 99 comprising a base 99*a* and hold plate 99*b* as shown in FIG. 11.

Figure 5:
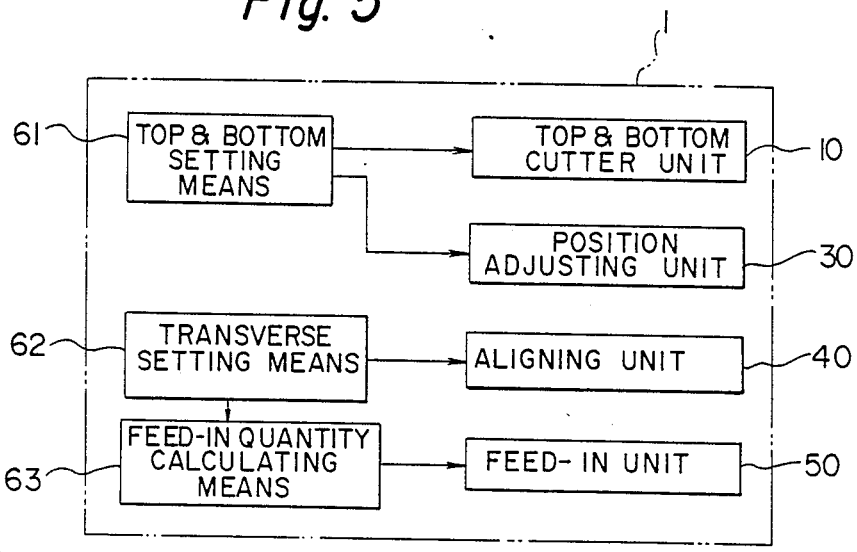
FIG. 5 is a schematic of the system of the cutting apparatus of the embodiment.
Figure 6:
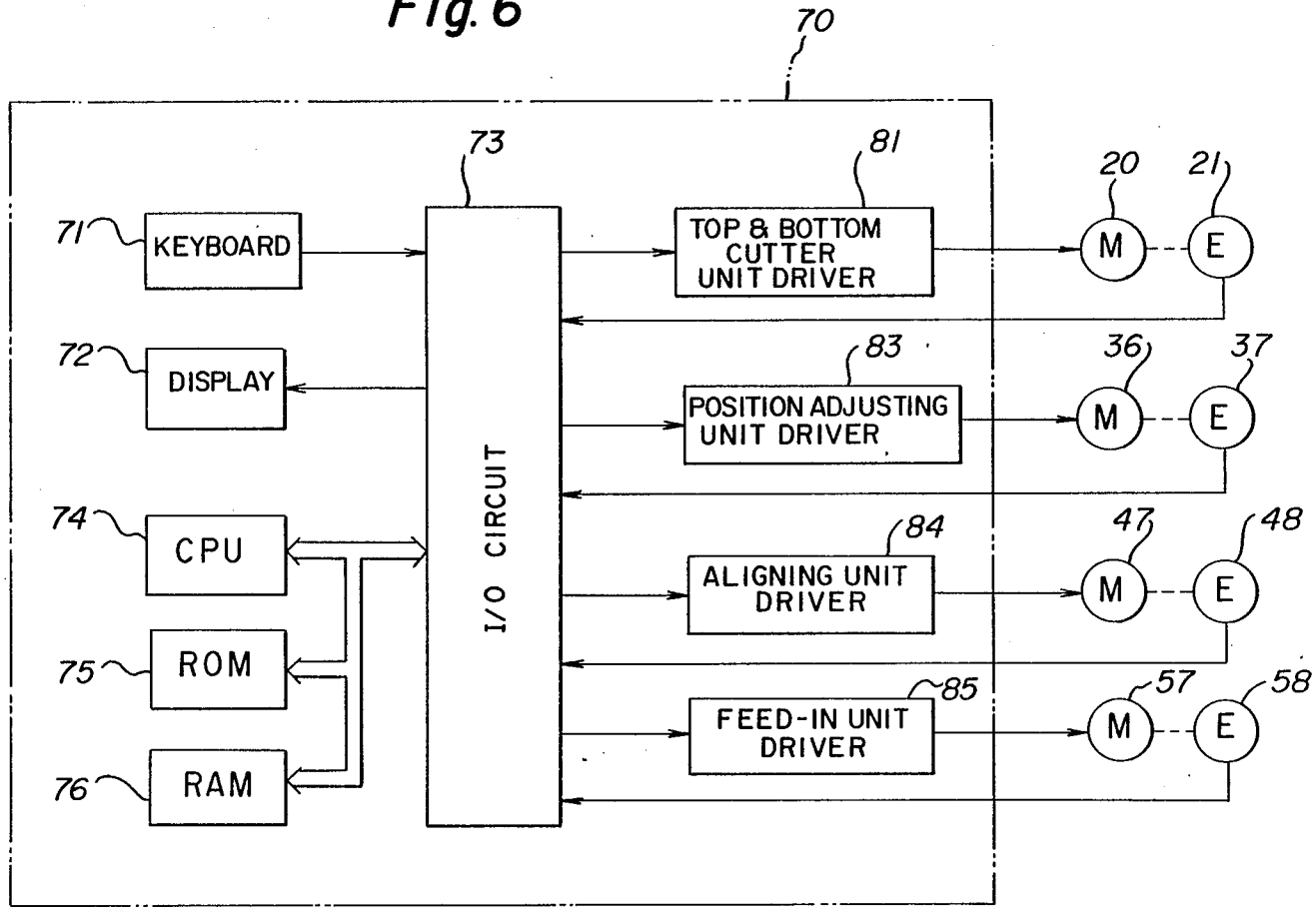
FIG. 6 is a block diagram of a control system of the embodiment.

FIG. 5 is a system schematic of a three-side cutter according to this invention. FIG. 6 is a block diagram showing the structure of the control system of the cutter. Size setting control device 70 includes a size inputting key 71, a display 72 and a CPU 74, a ROM 75, a RAM 76 and an input/output circuit 73, a top and bottom cutter driver 81, a position adjusting unit driver 83, an aligning unit driver 84, and a feed-in unit driver 85.

A keyboard 71 has keys which select top and bottom sizes and a transverse size and numeral keys which input data on the sizes. The keyboard is connected to an input/output circuit 73. Display 72 is connected to input-/output circuit 73 to allow the set sizes to be ascertained. The input/output circuit 73 includes amplifiers which digitize signals from encoders 21, 37, 48 and 58 and up/down counters which receive and count the respective position signals.

CPU 74 (central processing unit) sequentially reads out programs in ROM 75 and performs corresponding operations, and is connected to input/output circuit 73. ROM (read only memory) 75 stores programs executing respective processing and connected to CPU 74. RAM 76 temporarily stores various data on operations by CPU 74 and accessed by CPU 74 as needed. The top and bottom cutter unit driver 81 is connected to input-/output circuit 73 and produces a drive current for motor 20 of the cutter unit 10 in accordance with instructions of CPU 74 via input/output circuit 73 and supplies the drive current to the motor. Encoder 21, connected to input/output circuit 73, outputs a signal which is then counted accumulatively by input/output circuit 73 and CPU 74 to calculate the direction of rotation and a quantity of movement.

Position adjusting unit driver 83, connected to input-/output circuit 73, produces a drive current for motor 36 of position adjusting unit 30 in accordance with instructions from CPU 74 via input/output circuit 73 and supplies the drive current to the motor. Encoder 37, connected to input/output circuit 73, produces a signal, which is then counted accumlatively by input/output circuit 73 and CPU 74 to calculate the direction of rotation and a quantity of movement.

The aligning unit driver 84, connected to input/output circuit 73, produces a drive current for motor 47 of aligning unit 40 in accordance with instructions from CPU 74 via input/output circuit 73 and supplies the drive current to the motor. The encoder 48, connected to input/output circuit 73, produces a signal, which is then counted accumlatively by input/output circuit 73 and CPU 74 to calculate the direction of rotation and a quantity of movement.

The feed-in unit driver 85, connected to input/output circuit 73, produces a drive current to motor 57 of feed-in unit 50 in accordance with instructions from CPU 74 via input/output circuit 73. Encoder 58, connected to input/output circuit 73, produces a signal, which is then counted accumlatively by input/output circuit 73 and CPU 74 to calculate a quantity of movement. The distance which the back abutting member 52 travels in accordance with the calculated quantity of movement includes a first area which the back abutting member 52 travels directly after the member 52 starts to travel, a second intermediate area and a third area which the back abutting member 52 travels directly before it stops. The rotational speed of the motor 57 is controlled for each of the three areas.

Figure 7:
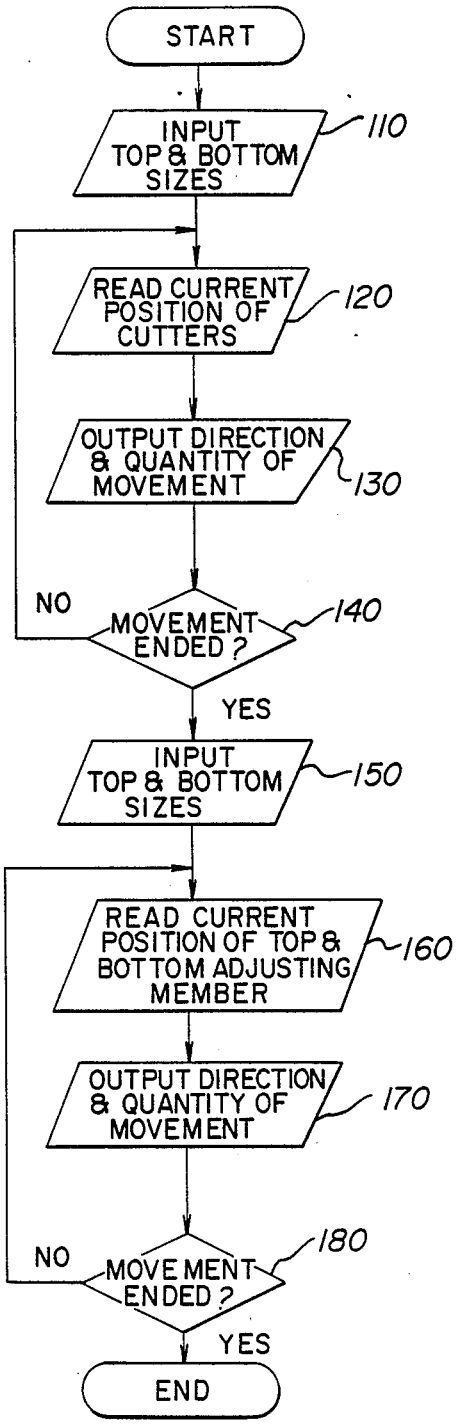
FIG. 7 is a flowchart for setting the position of the top and bottom cutting unit and position adjusting unit of the embodiment.
Figure 8:
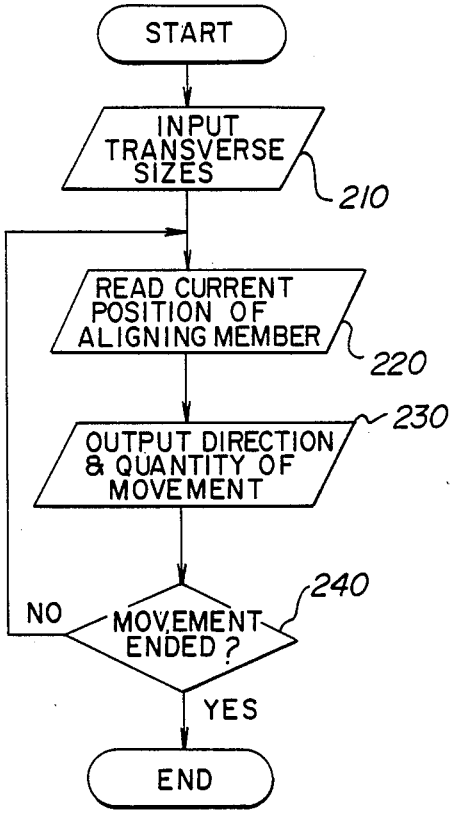
FIG. 8 is a flowchart for setting the position of the aligning unit.
Figure 9:
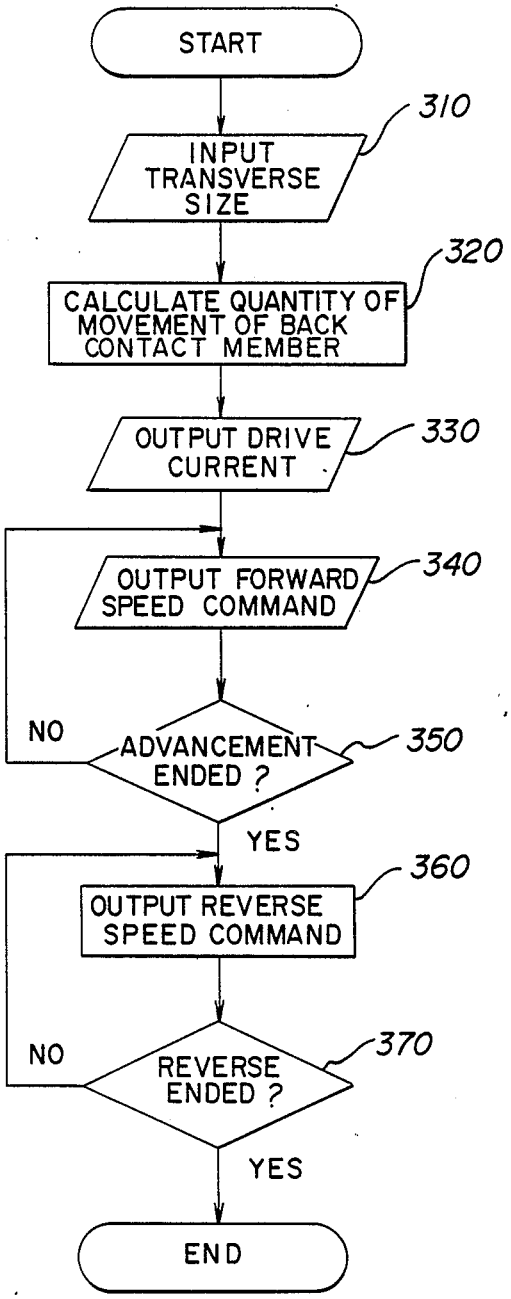
FIG. 9 is a flowchart for setting the distance of movement of the feed-in unit of the embodiment.
Figure 10A:
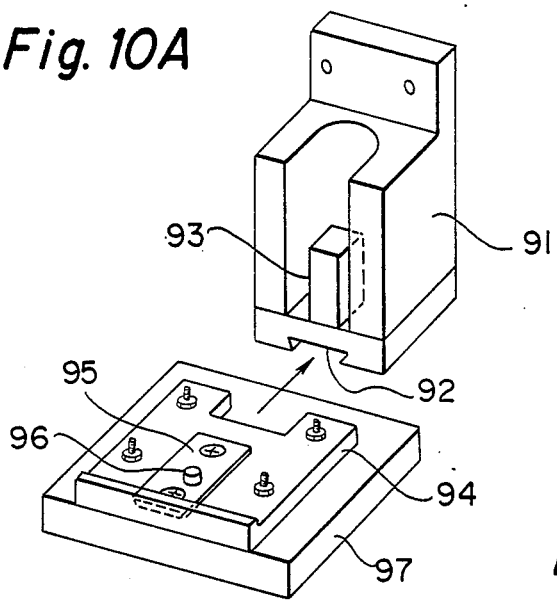
FIG. 10A is an exploded perspective view of the pushing member of the embodiment.
Figure 10B:
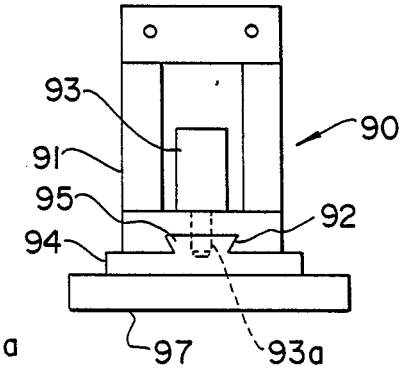
FIG. 10B is a front view of the pushing member.

The size setting operation of the three-side cutter constructed as just described above will now be described with reference to the flowcharts of FIGS. 7–9.

When data on the top and bottom positions at which the book is to be cut is keyed in by the keyboard 71 at a step 110, a shift is then made to step 120 where the current position of cutters 12 and 22 is read out in accordance with the output from encoder 21. A shift is then made to step 130 where the current position of the cutters 12 and 22 is compared with the input data on the top and bottom position and the direction and quantity of movement of cutters 12 and 22 are calculated and the drive current for motor 20 is output.

A shift is then made to step 140 where the latest position of cutters 12 and 22 obtained by rotation of motor 20 is read from the output of encoder 21, and it is determined whether the quantities of movement of cutters 12 and 22 have reached their set values. If no, a return is made to step 120 where cutters 12 and 22 continue to move. If yes, a shift is made to step 150 where setting the position of cutters 12 and 22 ends.

Subsequently, at step 150 input data on the top and bottom positions is ascertained. A shift is then made to step 160 where the current position of the top and bottom adjusting member 31 is read out from the output of encoder 37. A shift then is made to step 170 where the current position of the top and bottom adjusting member 31 is compared to the input data of the top and bottom positions, and the position where the top and bottom adjusting member 31 is set is calculated. At that position, the top and bottom crossing centerline of the book 7 coincides with the center line of cutters 12 and 22 when the book 7 having cutaway portions abuts on the adjusting member 31. The direction and quantity of the top and bottom adjusting member 31 are calculated with reference to that set position and the drive current for motor 36 is outputted.

A shift is then made to step 180 where the latest position of the adjusting member 31 brought about by rotation of motor 36 is read from the output of encoder 37, and it is determined whether the quantity of movement of the adjusting member 31 has reached the set value. If no, a return is made to step 160 where the movement of the adjusting member 31 continues while if yes, setting the position of the top and bottom adjusting member 31 ends. The processing at steps 110 and 150 corresponds to the top and bottom size setting means 61 according to this invention.

At step 210 when data on the transverse size at which the book is cut is keyed in, a shift is made to step 220 where the current position of the aligning member 41 is read out from the output of encoder 48. A shift is made then to step 230 where the current position of aligning member 41 is compared to the transverse size input to calculate the position where the aligning member 41 is set. At that set position, the book 7 is pushed against its back contact member 52 to align when the aligning member 41 is at an aligning position. The direction and quantity of movement of aligning member 41 is calculated with reference to that set position and the drive current for motor 47 is output.

A shift is then made to step 240 where the latest position of aligning member 41 brought about by rotation of motor 47 is read out from the output of the encoder 48 and it is determined whether the quantity of movement of aligning member 41 has reached its set value. If the determination is no, a return is made to step 220 where the movement of aligning member 41 continues while if yes, setting the position of aligning member 41 ends. The processing at step 210 corresponds to transverse size setting means 62 according to this invention.

If data on the transverse size is keyed in by keyboard 71 at step 310, a shift is made to step 320 where the numerical value of the transverse size of book 7 is substracted from the numerical values of the distance L between the back contact member 52 which is a reference point of movement and side cutter 49 to calculate the quantity of movement L2 of back contact member 52.

A shift is then made to step 330 where the drive current for motor 57 is output. A shift is then made to step 340 where the latest position of the back contact member 52 brought about by rotation of motor 57 is read from the output of encoder 58. When the back contact member 52 is in a first area of movement distance, the rotational speed of motor 57 is gradually increase; when the member 52 is in a second area of movement distance, the rotational speed of motor 57 is maintained constant; and when the member 52 reaches a third area, the rotational speed of motor is gradually decreased.

At step 350 it is determined whether the quantity of movement of back contact member 52 has reached its set value. If no, a return is made to step 340 where the movement of the contact member 52 continues while if yes the movement ends. A shift is then made to step 360 where a command for reversing motor 57 is issued to thereby reverse the contact member 52 and read the latest position of contact member 52 from the output of encoder 58. Speed commands are issued such that when the contact member 52 is in the third area of movement distance, the rotational speed of motor 57 is gradually increased; when the contact member is in the second area, the rotational speed of motor 57 is maintained constant; and when the contact member enters the first area, the rotational speed of motor 57 is gradually lowered.

At step 370 it is determined whether the reverse of the contact member 52 has completed. If NO, a return is made to step 360 where the reverse continues while if yes, the movement of the contact member 52 ends. When the next book 7 to be cut is carried in, the steps 330–370 are repeated to move the book 7. The processing step at 310 corresponds to the transverse size setting means 62 according to this invention and the processing at steps 320 and 330 corresponds to those at movement quantity calculating means 63.

The operation of the three-side cutting apparatus constructed as just described above will now be described. If a main switch for the cutter 1 is turned on, a predetermined power source voltage is supplied to size setting control unit 70 to put same under an operating state. The drive mechanism (not shown) is at a standby position of sequential control until a book to be cut 7 is carried in; the top and bottom cutter unit 10, side cutter 49, and hold member 90 are at their upper standby position; the aligning member 41 of aligning unit 40 is at an upper inoperative position; and the back contact member 52 of feed-in unit 50 is at its reversed position. When book 7 is carried onto base plate 3 by conveyor 5, it abuts at its top on the top and bottom adjusting member 31. Subsequently, the aligning member 41 is rotated by the drive mechanism to abut the back of the book 7 on the back contact member 52 for aligning purposes, and the aligning member 41 then returns to its inoperative position.

Subsequently, the feed-in unit 50 starts to operate, so that the contact member 52 advances to move the book 7 to a cutting position and reverses. The drive mechanism starts to operate to lower the hold member 90 from above to thereby push the book 7 against base plate 3.

The side cutter 49 and top and bottom cutter unit 10 are then lowered by the drive mechanism to cut book 7 at its top, bottom and side, and then cutter 49, cutter unit 10 and hold member 90 return to their upper standby position. The cut book 7 is transferred to and carried out by conveyor 6.

This invention is not limited to the structure of the above embodiment. Various changes and modifications could be made by those skilled in the art without departing from the technical concept of this invention.

What is claimed is:

1. A three-side cutting apparatus which aligns a carried-in book to be cut and transfers it to a cutting position to cut the book at its top, bottom and side, comprising:

top and bottom size setting means for receiving data on the top and bottom sizes of the book to be cut and outputting a signal indicative of the sizes;

transverse size setting means for receiving data on the transverse size of the book and outputting a signal indicative of the transverse size;

transfer quantity calculating means for calculating a quantity of transfer of the book to the cutting position on the basis of the signal indicative of the transverse size and outputting a signal indicative of the transfer quantity;

top and bottom cutter means operably connected to said top and bottom size setting means for cutting the top and bottom of the book having means for moving a pair of opposing cutters toward and away from each other under control of the signal outputted from said top and bottom size setting means indicative of the top and bottom sizes;

position adjusting means operably connected to said top and bottom size setting means controlled in accordance with a signal outputted from said top and bottom size setting means indicative of the top and bottom sizes for positioning said book relative to where said book is being fed in;

aligning means operably connected to said transverse size setting means controlled by the signal outputted from said transverse size setting means indicative of the transverse size for moving an aligning position and for positioning the back of the book, wherein said aligning means has a moving member for aligning the back of said book at a substantially orthogonal direction in which said book is carried in, and a shaft which extends substantially in the direction in which said book is carried in and having an aligning member for positioning the back of said book; and feed-in means for setting a distance based on the signal indicative of a movement quantity and moving the book to a cutting position, wherein said feed-in means has a book back abutting member substantially parallel to the direction in which the book is carried in to thereby have said position adjusting means, aligning means and feed-in means align and adjust the position of said book prior to cutting.

2. A three-side cutting apparatus according to claim 1, wherein the feed-in means includes a drive belt extending in the direction in which the book moves; and an electric motor means coupled to the drive belt for reciprocating the back abutting member between the position where said book is aligned and the cutting position.

3. A three-side cutting apparatus which aligns a carried-in book to be cut and transfers it to a cutting position to cut the book at its top, bottom and side, comprising:

top and bottom size setting means for receiving data on the top and bottom sizes of the book to be cut and outputting a signal indicative of the sizes;

transverse size setting means for receiving data on the transverse size of the book and outputting a signal indicative of the transverse size;

transfer quantity calculating means for calculating a quantity of transfer of the book to the cutting position on the basis of the signal indicative of the transverse size and outputting a signal indicative of the transfer quantity;

top and bottom cutter means operably connected to said top and bottom size setting means for cutting the top and bottom of the book, said cutter means have a pair of opposing cutters movable toward and away from each other under control of the signal outputted from said top and bottom size setting means indicative of the top and bottom sizes and have a clamp means for fixing the position of the cutters;

position adjusting means operably connected to said top and bottom size setting means controlled in accordance with a signal outputted from said top and bottom size setting means indicative of the top and bottom sizes for positioning said book relative to where said book is being fed in;

aligning means operably connected to said transverse size setting means controlled by the signal outputted from said transverse size setting means indicative of the transverse size for moving an aligning position and for positioning the back of the book, wherein said aligning means has a moving member for aligning the back of said book at a substantially orthogonal direction in which said book is carried in, and a shaft which extends substantially in the direction in which said book is carried in and having an aligning member for positioning the back of said book; and feed-in means for setting a distance based on the signal indicative of a movement quantity and moving the book to a cutting position, wherein said feed-in means has a book back abutting member substantially parallel to the direction in which the book is carried in to thereby have said position adjusting means, aligning means and feed-in means align and adjust the position of said book prior to cutting.

4. A three-side cutting apparatus according to claim 3, wherein the feed-in means includes a drive belt extending in the direction in which the book moves; a back abutting member fixed to the drive belt; and an electric motor coupled to the drive belt and reciprocating the back abutting member between the position where book is aligned and the cutting position.

* * * * *